United States Patent [19]

Barty

[11] 4,291,632

[45] Sep. 29, 1981

[54] BOTTOM STRUCTURE FOR CONTAINERS, LOAD-CARRYING PLATFORMS OR THE LIKE

[75] Inventor: Bernd Barty, Frösön, Sweden

[73] Assignee: AB Nordplat, Ostersund, Sweden

[21] Appl. No.: 131,859

[22] Filed: Mar. 19, 1980

[30] Foreign Application Priority Data

Mar. 3, 1979 [SE] Sweden ..... 7902782

[51] Int. Cl.[3] ..... B65D 19/02; B65D 19/06

[52] U.S. Cl. ..... 108/51.1; 206/386; 220/68; 428/167; 428/188; 428/326

[58] Field of Search ..... 428/167, 174, 326, 166, 428/188; 108/51.1, 901; 220/68; 156/62.2; 206/386, 599

[56] References Cited

U.S. PATENT DOCUMENTS 3,717,922 2/1973 Witowski ..... 108/51.1

3,858,526 1/1975 Lombard ..... 108/51.1

4,159,681 7/1979 Vandament ..... 108/901

*Primary Examiner*—Paul J. Thibodeau

*Attorney, Agent, or Firm*—Holman & Stern

[57] ABSTRACT

A bottom structure for containers, load-carrying platforms or the like, comprising a subjacent frame structure having longitudinal side beams and transverse beams extending therebetween, preferably in the form of pockets for lifting forks or the like, and a flooring of sheet material, preferably plywood, resting on the frame structure is provided with downwardly curved sheet-metal plates secured to the transverse beams as well as the longitudinal beams arranged between the transverse beams included in the frame structure and a load-distributing rigid filling, which supports the flooring between the transverse beams, is provided in the spaces above said plates up to the level of the upper sides of the transverse beams and the underside of the flooring.

3 Claims, 2 Drawing Figures

BOTTOM STRUCTURE FOR CONTAINERS, LOAD-CARRYING PLATFORMS OR THE LIKE

BRIEF SUMMARY OF THE INVENTION

The present invention relates to a bottom structure for containers, load-carrying platforms or the like, comprising a subjacent frame structure having longitudinal side beams and transverse beams extending therebetween, preferably in the form of pockets for lifting forks or the like, and a flooring of steel material, preferably plywood, resting on the frame structure.

In conventional bottoms for containers, load-carrying platforms or the like the frame structure includes, in addition to said longitudinal and transverse beams, a large number of closely spaced steel profiles the purpose of which is to constitute a support for the flooring which generally consists of plywood. Container floors must be able to resist not only the load of goods placed thereon but also the heavy point loads arising from goods handling trucks.

However, conventional constructions involve several disadvantages. The profiles, which as a rule are Z-profiles, are at both ends welded to the longitudinal beams and the form of the profiles makes the welding work troublesome and also difficult to check. The numerous pockets and steps formed as well as the extended welds caused by the profiles often lead to corrosion which may jeopardize the strength. If a profile is deformed due to careless load handling it is almost impossible to exchange it without removing the flooring of the container since otherwise no welding can take place.

The object of this invention is to provide a structure which eliminates the need for transverse profiles, provides a clean underside, reduces the manufacturing cost and is easy to repair.

The essential characteristic of the structure according to the invention is that downwardly curved sheet-metal plates, secured to the transverse beams as well as the longitudinal beams, are arranged between the transverse beams included in the frame structure and that a load distributing rigid filling, which supports the flooring between the transverse beams, is provided in the spaces over said plates up to the level of the upper sides of the transverse beams and the underside of the flooring.

BRIEF DESCRIPTION OF THE DRAWING

An embodiment of a bottom structure according to the invention will be described more fully below with reference to the accompanying drawing, in which.

DETAILED DESCRIPTION

Figure 1:
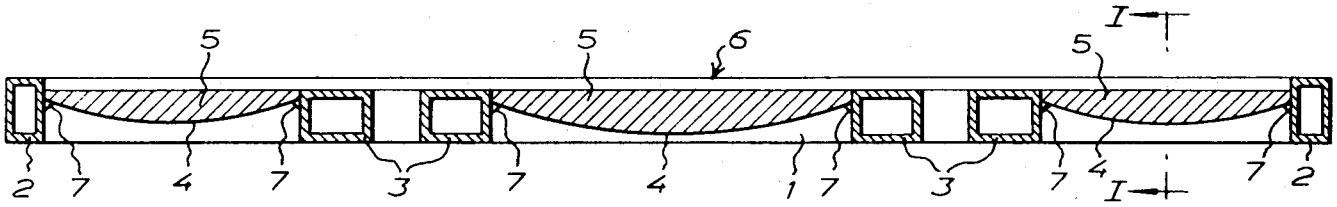
FIG. 1 is a longitudinal section of such a bottom.
Figure 2:
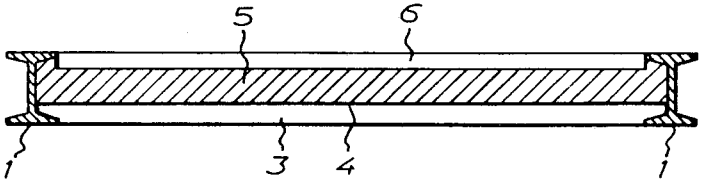
FIG. 2 is a cross-section on line I—I in FIG. 1.

In the drawing, the two longitudinal beams, which are I-shaped, are designated by 1. Arranged between these beams and at the ends thereof are transverse beams 2 and also arranged between the longitudinal beams are four so-called lift-fork pockets 3 consisting of square tubes and also serving as transverse beams. These pockets are designated to receive the forks of fork lift trucks and like load handling implements.

In a container bottom of conventional design three to four Z-profiles would be welded in the interspaces between transverse beams and square tubes in order to constitute a support for the flooring.

Interposed between the transverse beams or like members are, according to the invention, downwardly curved sheet-metal plates 4 which are secured to said beams along their edges. Provided in the spaces above these plates up to the level of the upper side of the fork pockets 3 is a load-distributing filling 5.

Such a filling consists of a comparatively light, pressure-resistant material, for instance glued chip material of the type included in chip boards.

A flooring 6 consisting of plywood or other sheet material is placed on top of the filling 5 which suitably has been applied in pre-formed pieces.

Due to the influence of the load-distributing filling compressive stresses on the floor will be distributed over a large area of the respective plate which, like a diaphragm, is subjected to tensile stress which is transferred to the transverse beams via the welds 7 along the plate edges.

The construction described above results in a substantial reduction of weight and it will thus facilitate and cheapen the manufacture.

It will be easier to repair damages by welding which with normal care can be carried out with the filling and floor left in unchanged position.

The invention should not be considered limited to that described above and shown in the drawing but it can be modified in various ways within the scope of the appended claims.

What I claim and desire to secure by Letters Patent is:

1. A bottom structure for load-carrying platforms, comprising a subjacent frame structure having longitudinal side beams and transverse beams extending therebetween having pockets for lifting forks, and a flooring of sheet material made of plywood resting on the frame structure, downwardly convex curved sheet-metal plates between said transverse beams secured at their edges to the upper portions of said transverse beams and said longitudinal side beams included in the frame structure, and a load-distributing rigid filling which supports the flooring between said beams filling the spaces above said plates up to the level of the upper sides of said transverse beams and the underside of said flooring.

2. A bottom structure as claimed in claim 1, wherein the plates are curved in the transverse direction of the frame structure.

3. A bottom structure as claimed in claim 1 or 2, wherein said load-distributing filling comprises glued chipped wood material.

* * * * *